US008366563B2

(12) United States Patent
Kuhlman

(10) Patent No.: US 8,366,563 B2
(45) **Date of Patent: *Feb. 5, 2013**

(54) GOLF ALIGNMENT DEVICE AND METHOD

(76) Inventor: John Kuhlman, Burr Ridge, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/294,817

(22) Filed: Nov. 11, 2011

(65) Prior Publication Data

US 2012/0149484 A1 Jun. 14, 2012

Related U.S. Application Data

(63) Continuation-in-part of application No. 12/772,389, filed on May 3, 2010, now Pat. No. 8,057,321, which is a continuation-in-part of application No. 12/380,506, filed on Feb. 27, 2009, now Pat. No. 7,727,079.

(51) Int. Cl.
*A63B 69/36* (2006.01)

(52) U.S. Cl. ..... 473/266; 473/218

(58) Field of Classification Search ..... 473/218, 473/219, 257, 266, 270–273, 278
See application file for complete search history.

(56) References Cited

U.S. PATENT DOCUMENTS

| | | | | |
|---|---|---|---|---|
| 3,459,429 | A | 8/1969 | Green | 473/218 |
| 3,708,174 | A | 1/1973 | Kamarauskas | 473/273 |
| 5,029,868 | A | 7/1991 | Cloud | |
| 5,042,815 | A | 8/1991 | Sutton | |
| 5,165,691 | A | 11/1992 | Cook | |
| 5,435,562 | A | 7/1995 | Stock et al. | |
| 5,452,897 | A | 9/1995 | Mick | |
| 5,467,991 | A | 11/1995 | White, IV et al. | |
| 5,467,992 | A | 11/1995 | Harkness | |
| 5,713,798 | A | 2/1998 | Brodie, Jr. | 473/55 |
| 5,738,595 | A | 4/1998 | Carney | |
| 5,759,110 | A | 6/1998 | Seibel et al. | |
| 5,810,674 | A | 9/1998 | Falossi et al. | |
| 5,818,036 | A | 10/1998 | Daly | |
| 5,873,789 | A | 2/1999 | Torriano | 473/220 |
| 6,007,436 | A | 12/1999 | Mark | |
| 6,213,887 | B1 | 4/2001 | Carney | |
| 6,383,087 | B1 | 5/2002 | Moser | |
| 6,440,004 | B1 | 8/2002 | Rodriguez | 473/218 |
| 6,672,972 | B1 | 1/2004 | Stone | |
| 6,767,291 | B1 | 7/2004 | McCarthy | |
| 6,827,651 | B1 | 12/2004 | Davis | 473/2 |
| 7,112,145 | B2 | 9/2006 | Gaddy | 473/220 |
| 7,118,488 | B2 | 10/2006 | Chan et al. | |
| 7,134,966 | B1 | 11/2006 | Tice | |
| 7,160,198 | B2 | 1/2007 | Coates | |
| 7,207,896 | B1 | 4/2007 | Sudol | |
| 7,575,522 | B1 * | 8/2009 | Affrunti | 473/273 |

(Continued)

OTHER PUBLICATIONS

PCT Search Report and Opinion PCT/US11/035858 Feb. 29, 2012.

*Primary Examiner* — Nini Legesse
(74) *Attorney, Agent, or Firm* — Clifford Kraft

(57) ABSTRACT

A portable, expandable golf training device that can be placed on the ground to provide alignment. The present invention can supply a plurality of light beams produced by lasers or other light sources or a plurality of extendable tapes or tubes or rods to provide alignment both in the direction of play and perpendicular to it. The device can be used by placing it on the ground in front of the golfer (between the golfer's feet and the ball. Two lines can project outward perpendicular to the direction of play, and two or four lines can project into and away from the direction of play. These lines provide alignment for the golfer. The tapes can be a flat, elongated flexible tape similar to a measuring tape. The rods or tubes can be extendable and/or telescoping.

12 Claims, 12 Drawing Sheets

U.S. PATENT DOCUMENTS

| | | | | |
|---|---|---|---|---|
| 7,727,079 | B1 * | 6/2010 | Kuhlman, Jr. | 473/220 |
| 8,057,321 | B2 * | 11/2011 | Kuhlman | 473/266 |
| 2002/0098902 | A1 | 7/2002 | Rodriguez | |
| 2005/0261072 | A1 | 11/2005 | Adams | |
| 2008/0229601 | A1 * | 9/2008 | Lightfoot | 33/700 |
| 2010/0267460 | A1 | 10/2010 | Kuhlman, Jr. et al. | |

* cited by examiner

GOLF ALIGNMENT DEVICE AND METHOD

This application is a continuation-in-part of co-pending application Ser. No. 12/772,389 filed May 3, 2010 which was a continuation in part of application Ser. No. 12/380,506 filed Feb. 27, 2009 issuing as U.S. Pat. No. 8,057,321. Application Ser. Nos. 12/772,389 and 12/380,506 are hereby incorporated by reference.

BACKGROUND

1. Field of the Invention

The present invention relates generally to the field of sport improvement devices and more particularly to a laser or tape golf or other sport alignment device and method.

2. Description of the Prior Art

There are numerous devices known in the art that place a laser or other light source somewhere on or near a golf club. For example, U.S. Pat. No. 6,007,436 teaches a laser system that helps align the golfer's feet in relation to the ball. U.S. Pat. No. 5,029,868 describes a practice high intensity light source mounted on a golf club. US 2005/0261072 describes a golf club alignment device with one or two laser units connected to a golf club. U.S. Pat. No. 5,435,562 teaches a golf club having a laser generating diode and laser reflecting prism. U.S. Pat. No. 5,042,815 describes a grid-like reference system for obtaining a properly aligned golf stance. U.S. Pat. No. 5,467,991 teaches a self-contained portable unit attachable to the shaft of a golf club that supplies a beam of light. U.S. Pat. No. 5,165,691 discloses a laser golf putter assembly mounted on the putter club. U.S. Pat. No. 5,738,595 describes a hand-held laser pointing device. U.S. Pat. No. 5,818,036 describes a laser aided practice putting device. U.S. Pat. No. 5,452,897 teaches a laser putter alignment system with a mirrored surface on the ball-striking surface of the putter club. U.S. Pat. No. 6,213,887 teaches an apparatus for practicing golf using a laser aiming device. U.S. Pat. No. 7,134,966 describes a golf putt training device using a light apparatus positioned behind the ball. U.S. Pat. No. 7,118,488 discloses a training putter with a laser line projecting device. U.S. Pat. No. 6,672,972, U.S. Pat. No. 5,467,992 and U.S. Pat. No. 7,207,896 teach hat-mounted laser golf devices. U.S. Pat. No. 7,160,198 teaches a golf club swing training system. U.S. Pat. No. 6,383,087 discloses a golf putting alignment system using lasers for determining the aiming tendencies of a golfer. U.S. Pat. No. 6,767,291 teaches a putting device that includes lasers mounted on a putter. U.S. Pat. No. 5,810,674 discloses a golf club with light sources. U.S. Pat. No. 5,759,110 teaches a swing training device with a light beam along the longitudinal axis of the golf club.

All of these and other prior art methods suffer from either having a light source attached to the moving golf club or not projecting a beam where the golfer needs it most. It would be advantageous to have a laser golf alignment system and method that can place right angle beams on the ground in the direction of ball travel and perpendicular to that direction. It would also be advantageous to be able to project two separated beams in the direction of ball travel for putting. In the alternative, it would be advantageous to have a sport tape alignment system that did not require any power or batteries.

SUMMARY OF THE INVENTION

The present invention relates to a portable, expandable golf training device that can be placed on the ground to provide alignment using either a laser beam or a set of extendable tapes. The present invention can supply a plurality of light beams produced by lasers or other light sources, switchable on and off, that can be projected along the ground both in the direction of play and perpendicular to it. In a folded configuration, the device can project in four directions creating a pair of axis lines running at right angles to each other. In an expanded configuration, one of the major axis lines can be separated into two parallel lines for putting alignment by sliding the halves of the device apart. The device can be used by placing it on the ground of the golfer (between the golfer's feet and the ball for iron or wood, and about a foot behind the ball for putting). The device can also be placed with the ball between the golfer and the device. Two lines project outward perpendicular to the direction of play, and two or four lines project into and away from the direction of play. These lines provide alignment for the golfer. Various combinations of beams on or off can be selected by a selector switch under control of the user. The device can contain a rechargeable battery.

In an alternative embodiment, the device of the present invention can contain one or more tape reels with wound-up tape like those used for tape measures. This tape can be extended along the ground in place of a light beam. This embodiment is particularly advantageous in bright sunlight where a laser beam is hard to see and in that it does not require any electrical parts.

DESCRIPTION OF THE FIGURES

Attention is now called to several illustrations that depict features of the present invention.

Several drawings and illustrations have been provided to aid in understanding the present invention. The scope of the present invention is not limited to what is shown in the figures.

DETAILED DESCRIPTION OF THE INVENTION

The present invention relates to a golf alignment method and system that uses lasers or other light sources to project beams of light from a position on the ground between the golfer's feet and the ball, or in alternative embodiments uses extendable tapes similar to those used in tape measures to mark alignment along the ground.

Figure 1:
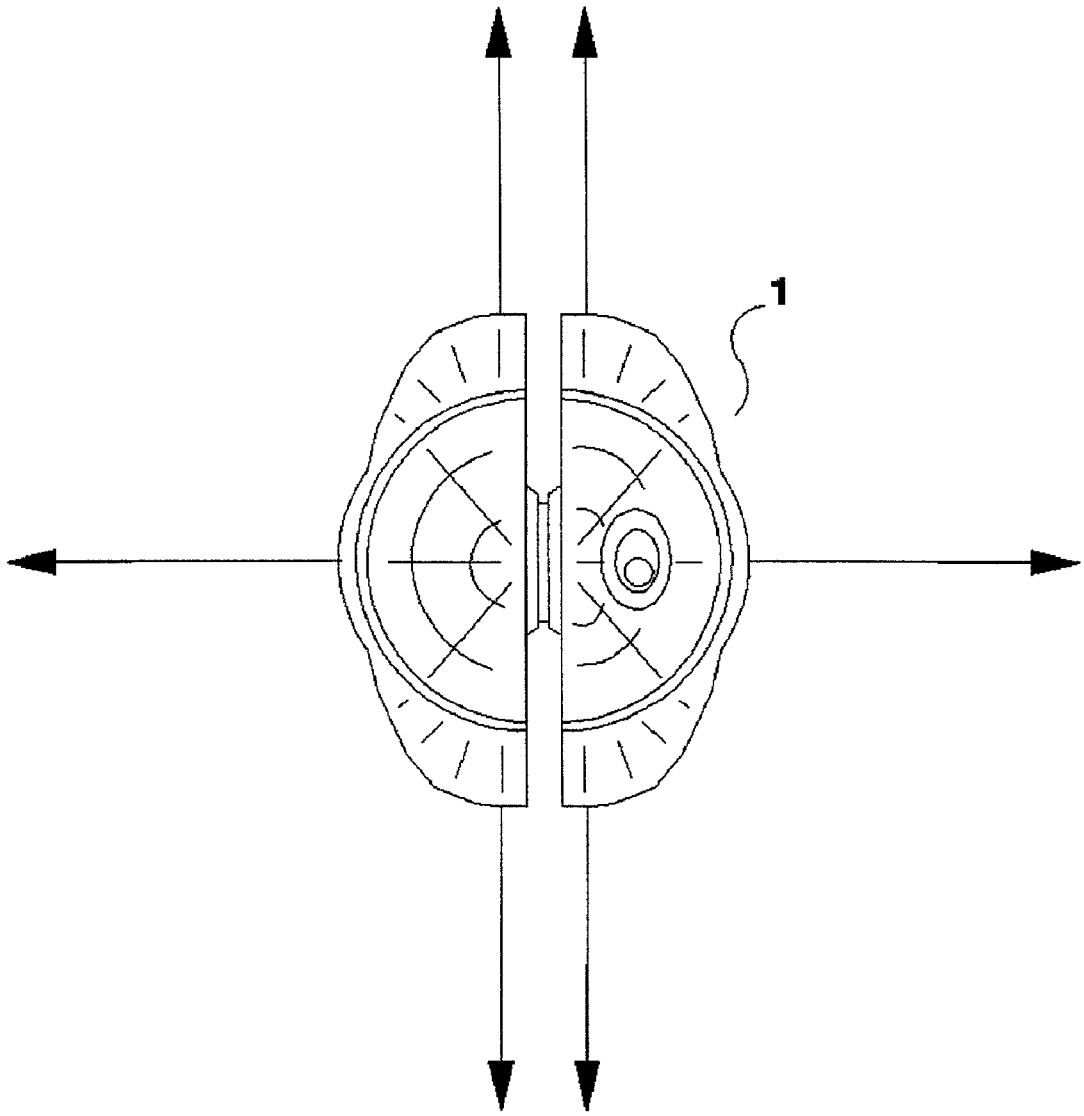
FIG. 1 shows a view of an embodiment of the present invention in the folded configuration providing four or six light beams.

A small, battery-powered device shown in FIG. 1 can project laser beams and can be placed on the ground. In a contracted configuration, a first pair of lines is generally projected perpendicular to the direction of play (direction of ball travel). One of these first pair of lines projects outward to the ball. The second projects backward toward the golfer's feet. A second pair of lines project into and away from the direction of play (this can be four lines as shown in FIG. 1). The device can be aligned so that the lines parallel to the direction of play are correct. This causes the perpendicular lines to then also be correct. The golfer is thus in an aligned position to swing.

In an expanded configuration, a pair of parallel beams for putting can be projected along the line of play. The device can be pulled apart from the contracted to the expanded configuration to separate the lines. In any configuration, various beams can be generally switched on and off.

Figure 2:
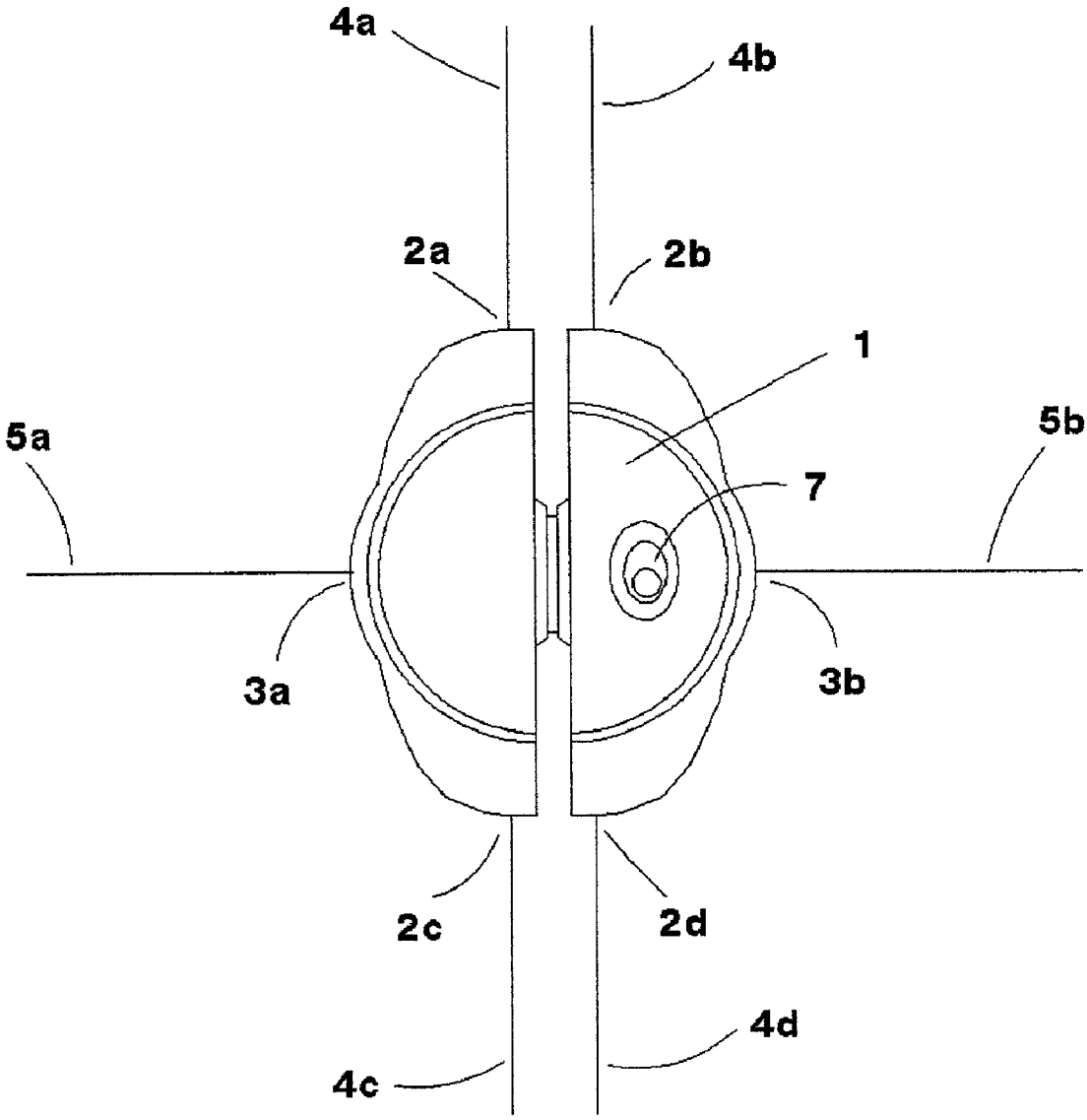
FIG. 2 is similar to FIG. 1 except that the various components of the system are labeled.

Turning to FIG. 2, a different depiction of the embodiment of FIG. 1 can be seen. The device 1 projects beams 5*a* and 5*b* perpendicular to the line of play and beams 4*a*, 4*b* and 4*c*, 4*d* parallel to the line of play. The beams are projected from lasers or laser ports 3*a*-3*b* and 2*a*-2*d*. A switch 7 on the device can switch the device on and off and control which beams are currently projecting. The configuration shown in FIGS. 1-2 is the contracted or non-expanded configuration.

Figure 3:
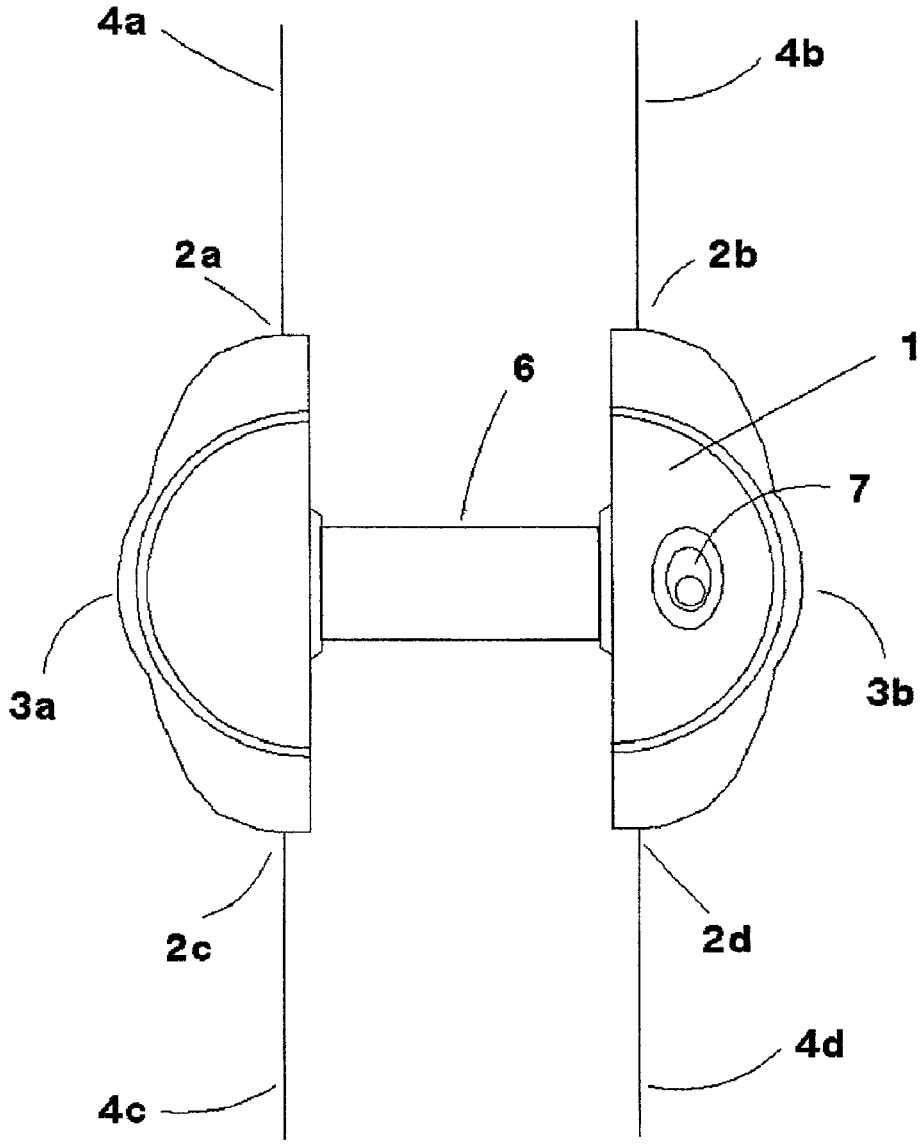
FIG. 3 shows a view of the embodiment of FIGS. 1-2 in the extended configuration providing six light beams.

FIG. 3 shows an embodiment of the device in an expanded configuration. By pulling the two halves apart the beams 4*a*, 4*c* can be separated from the beams 4*b*, 4*d*. FIG. 3 shows the other beams off. The invention can be mechanically configured to pull apart along a connecting slider bar 6. This bar 6 can connect the two halves both mechanically and electrically.

Figure 4:
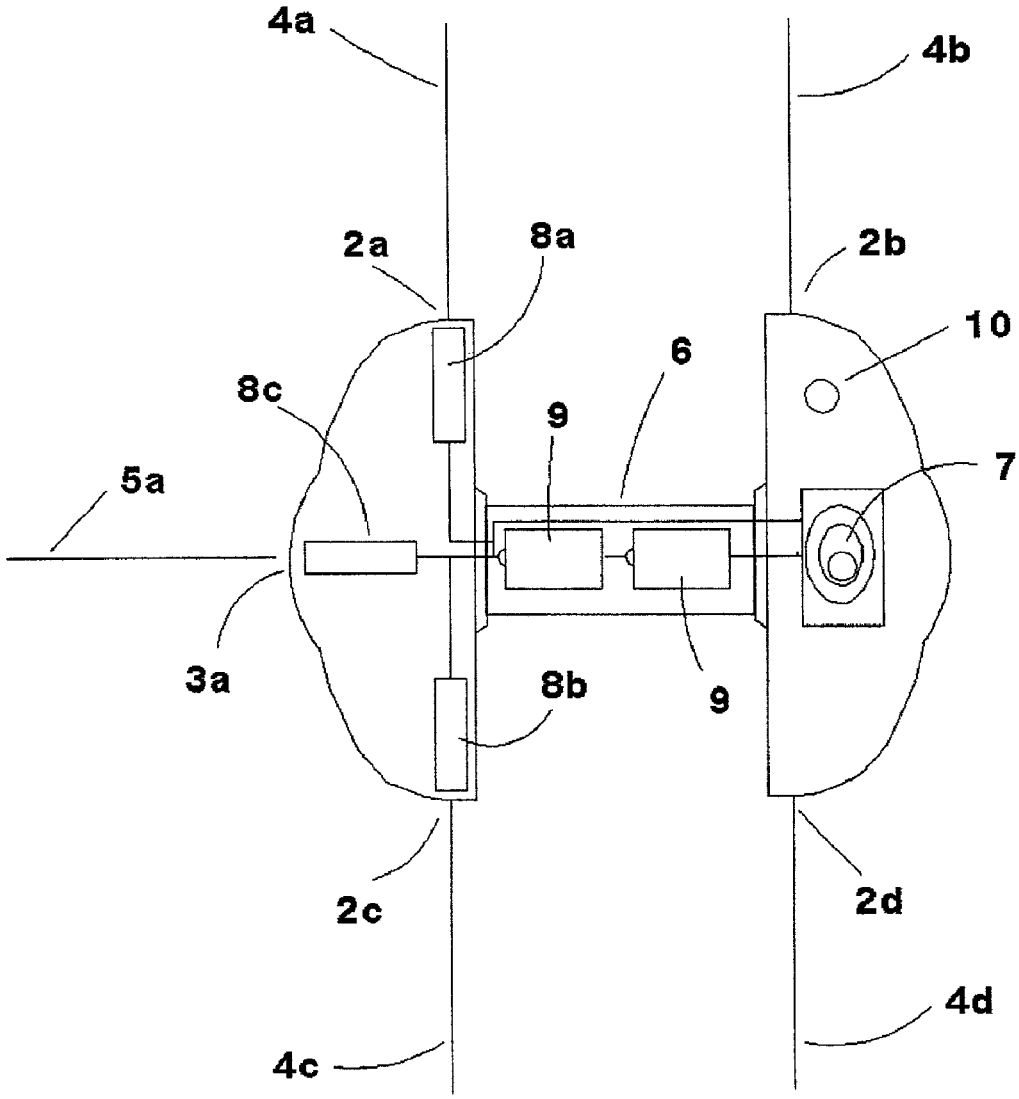
FIG. 4 shows the internal components of an embodiment of the invention.

FIG. 4 shows an embodiment of the present invention where some of the internal components can be seen. While FIG. 4 shows some connections, and the placement of some parts, various electrical connections are possible and any parts configuration is within the scope of the present invention. Three lasers 8*a*, 8*b* and 8*c* are shown in FIG. 4. These lasers are used to create beams 4*a*, 4*c* and 5*a* respectively. A pair of rechargeable batteries 9 are shown located in the center separation bar 6. The laser select and off-on switch 7 can be see along with a charging port 10 for charging the batteries 9. While two batteries 9 are shown, it will be appreciated that any number of batteries, including one, can be used to supply the correct voltage and current requirements of the device. Alternate embodiments of the invention can be made with non-rechargeable batteries.

Figure 5:
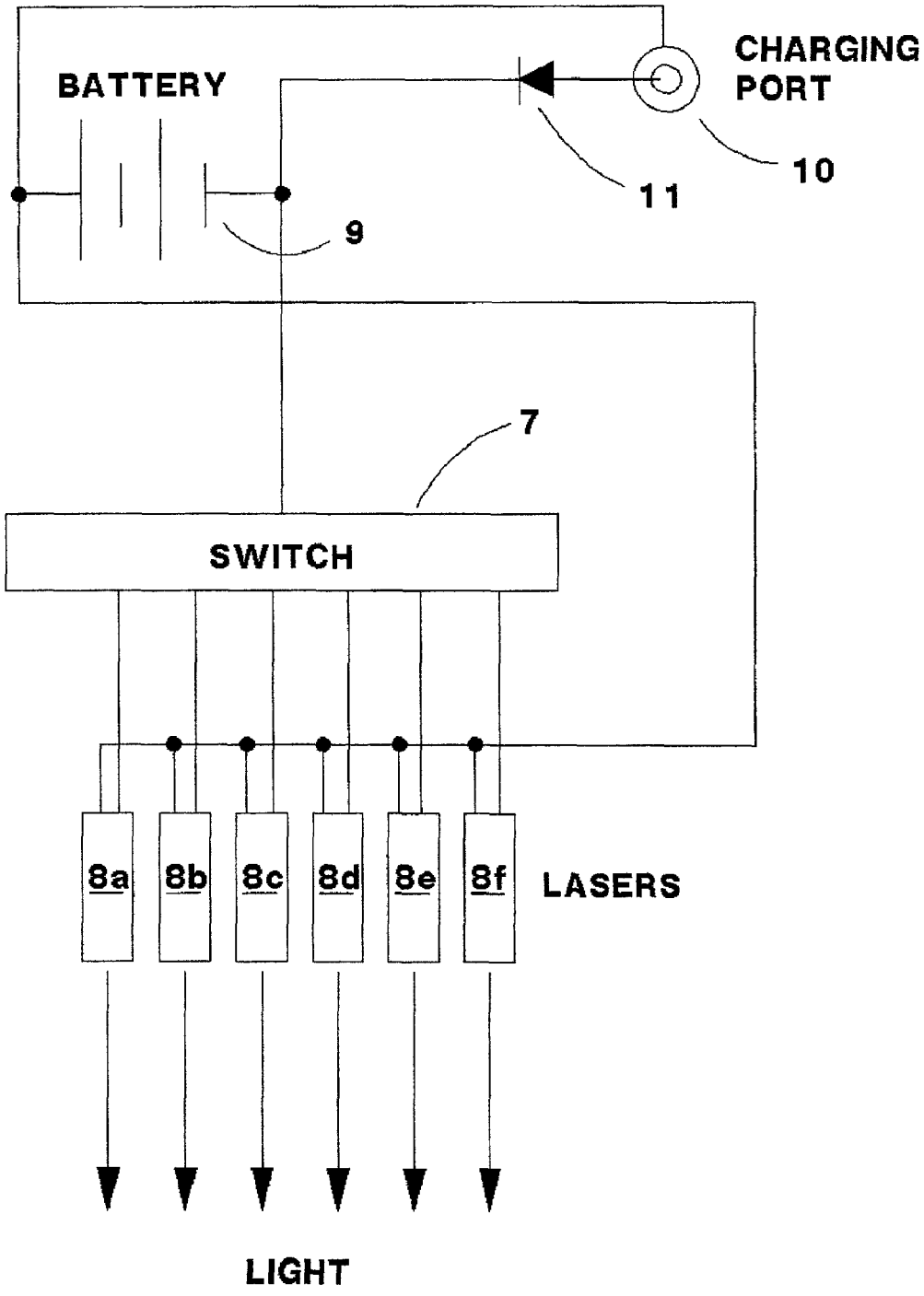
FIG. 5 shows a block diagram of the electronic portions of the invention.

FIG. 5 shows an electrical schematic diagram of an embodiment of the present invention. This schematic is representative of a preferred way of implementing the principles of the invention. It will be appreciated by one with skill in the art that numerous different circuits can be used to realize the invention. In FIG. 5, the battery 9 is connected through an optional diode 11 to an optional recharge port 10. A DC voltage from a wall transformer rectifier can be supplied to this port to recharge the battery. Alternatively, the device can include a rectifier so that AC voltage can be supplied to recharge the battery. The battery 9 is also connected to a selector switch component 7. This switch 7 can be chosen to select various desired combinations of laser beams from the various lasers 8*a*, 8*b*, 8*c*, 8*d*, 8*e* and 8*f*.

Figure 6:
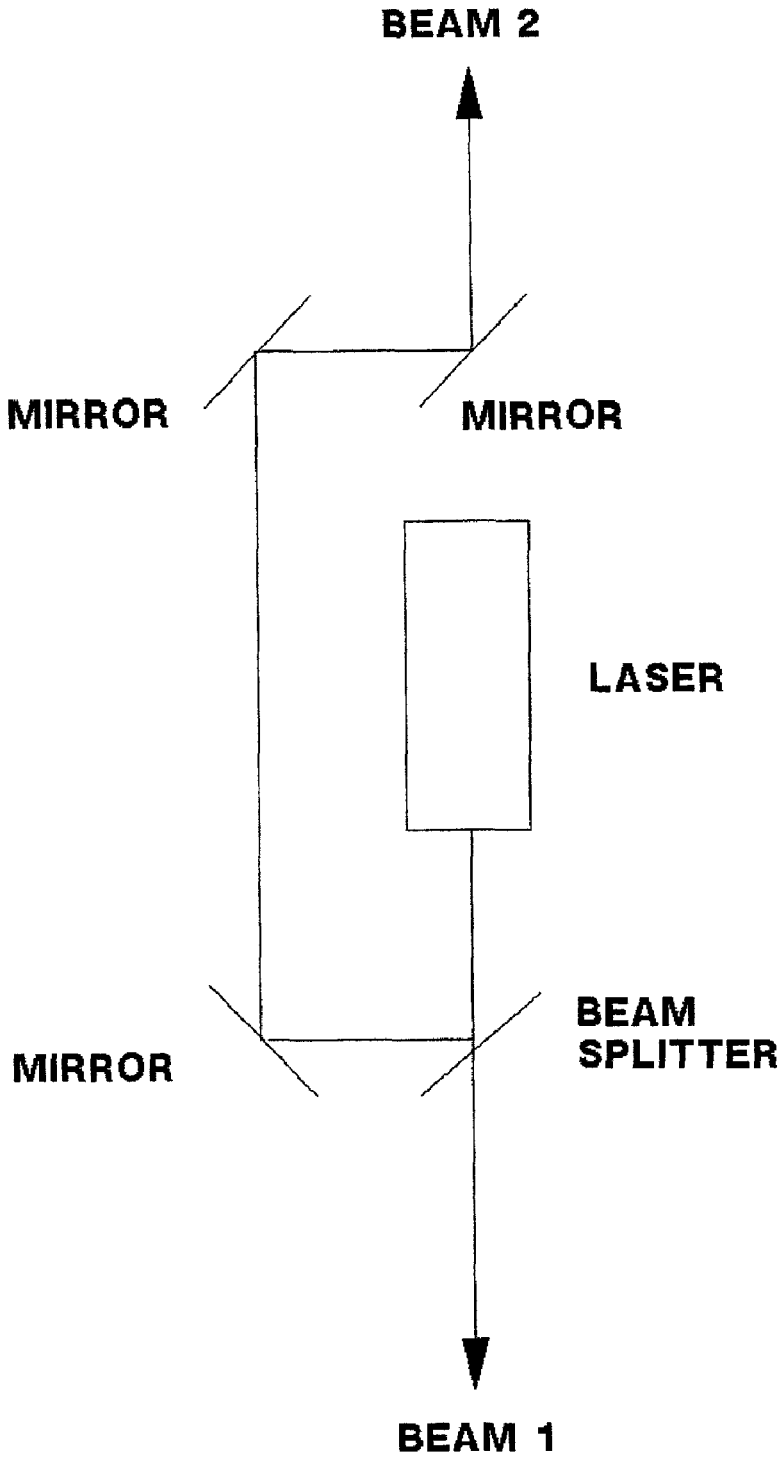
FIG. 6 shows a way of making multiple beams using a splitter and mirrors.

The embodiment of the present invention depicted in FIGS. 4-5 use several different lasers, one for each beam. It is well known in the art that a laser beam can be split. The use of a beam splitter and mirrors to cut down on the number of lasers required and the power requirements is within the scope of the present invention and is shown in FIG. 6. While this method cuts down on the number of lasers, those used must generally have more light output. In FIG. 6, the beam from a laser is split into two beams by a beam splitter. The first beam continues out of the device. The second beam is reflected by three mirrors to project out from the opposite direction from the first beam. It is within the scope of the present invention to use any number of beam splitters and mirrors to cut down on the number of lasers. Embodiments of the present invention can also be constructed with two beams, three beams, four beams and five beams of light. It is not necessary to have six beams as is shown in FIGS. 1-2.

In all cases, whether the beams are split, or whether individual lasers are used for each beam, careful alignment of the beams to be as close as possible to parallel and perpendicular is necessary. Also, all light-emitting, splitting or reflecting components should be firmly mounted to the housing to prevent shifting during use. If possible, the device should be designed to be robust in the case it is accidentally dropped of banged into something.

It should be noted that while the preceding description describes the use of lasers as light sources, any type of light source may be used such as LEDs, flashlight type beams or the like. Any type of light source of any color that can be formed into a beam is within the scope of the present invention.

Figure 7A:
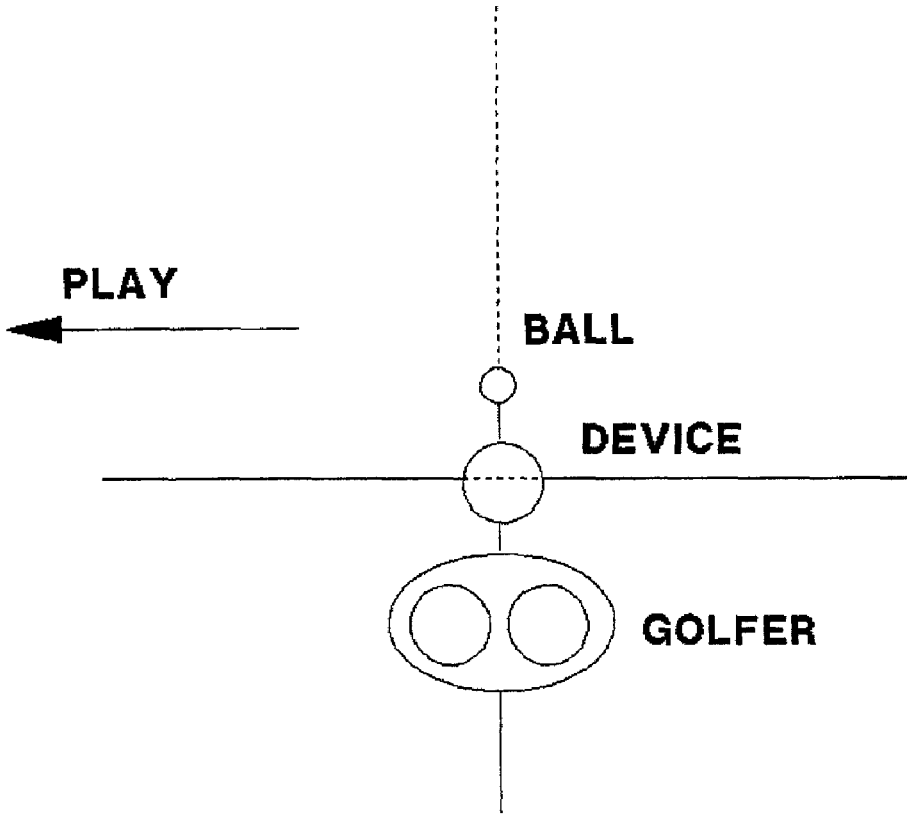
FIGS. 7A-7B show placement of the device with respect to the golfer and the ball.
Figure 7B:
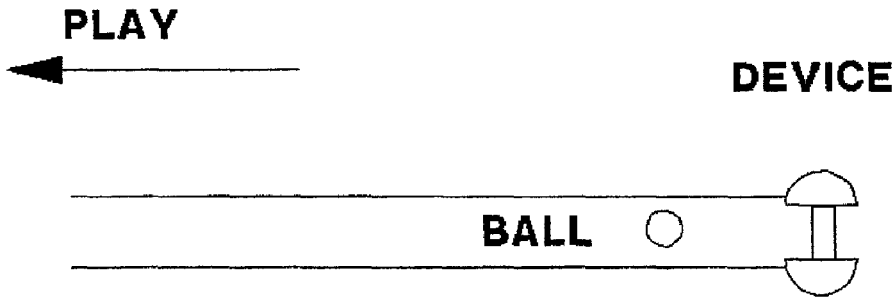

Turning to FIGS. 7A-7B, placement of the device of the present invention on the ground can be seen. FIG. 7A shows the placement is that used for wood and irons with the device positioned around half way between the golfer's shoe tips and the ball. It can also be placed with the ball between the device and the golfer. FIG. 7B shows the placement used for putting with the device around a foot behind the ball.

Figure 8:
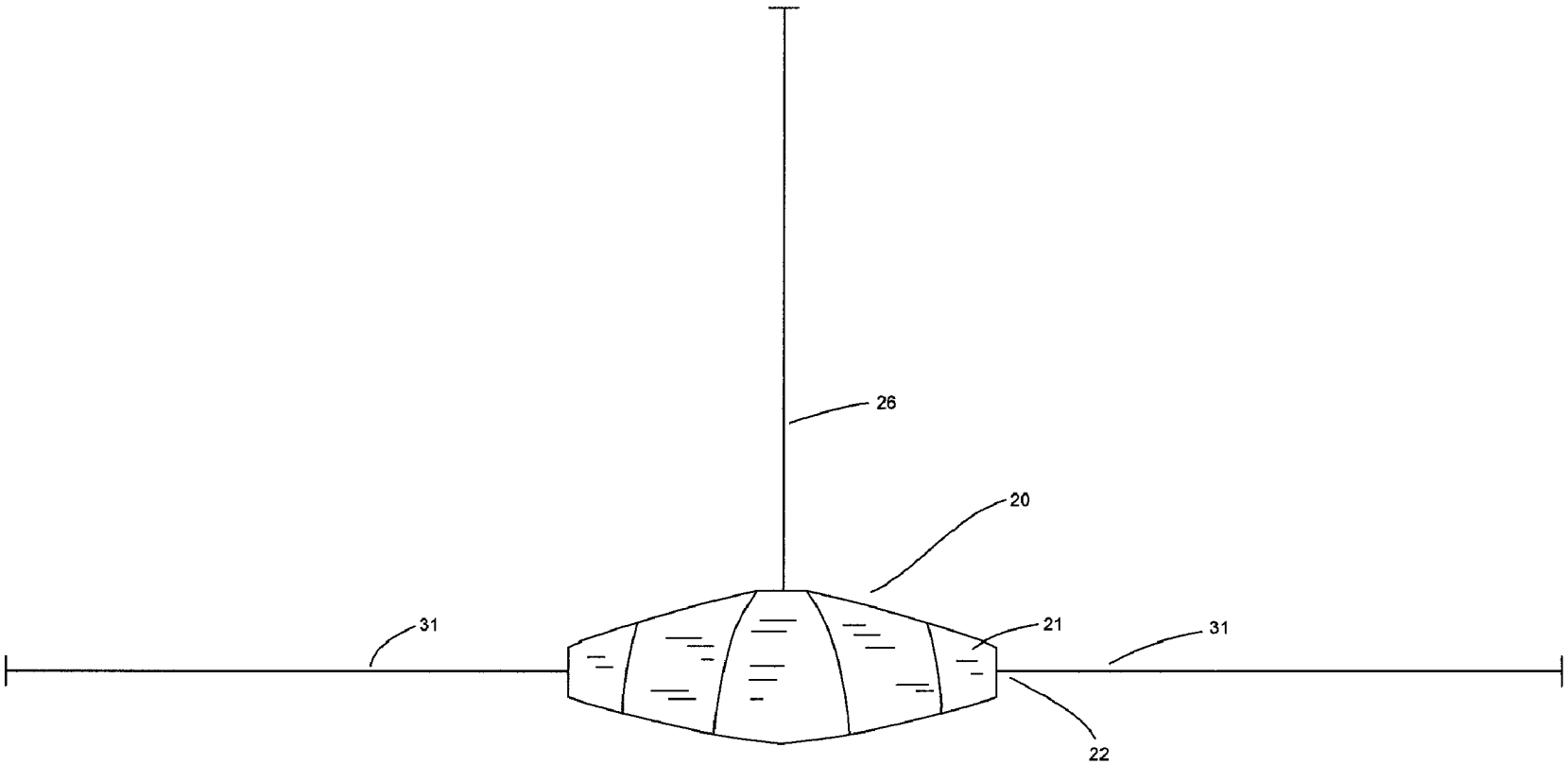
FIG. 8 shows a top view of an embodiment of the present invention that uses tapes instead of light sources.
Figure 9:
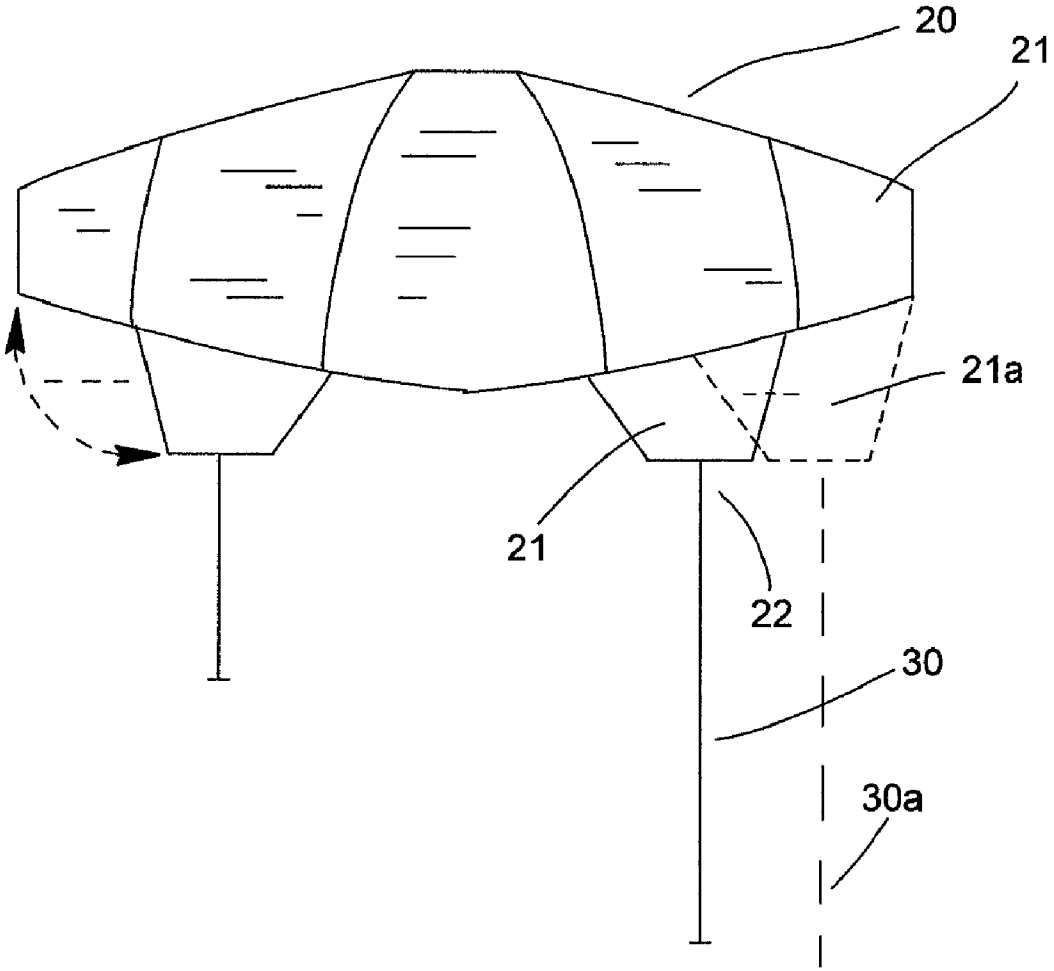
FIG. 9 shows the positions of tape exits in the embodiment of FIG. 8.

FIG. 8 shows an embodiment of the present invention that uses extendable tapes 26, 31 instead of laser or other light beams. The device includes a body 20 that can project tape in three or more directions. Each end optionally can contain a swivel or sliding head 21. FIG. 9 shows the heads 21 swiveled to a perpendicular position from the position of FIG. 8. In addition, each head 21 can optionally slide inwardly and outwardly to move the tape 30 to a position parallel 30*a* that is differently spaced. The embodiments of the present invention with tape, can take any path that other embodiments with light beams could take.

Figure 10:
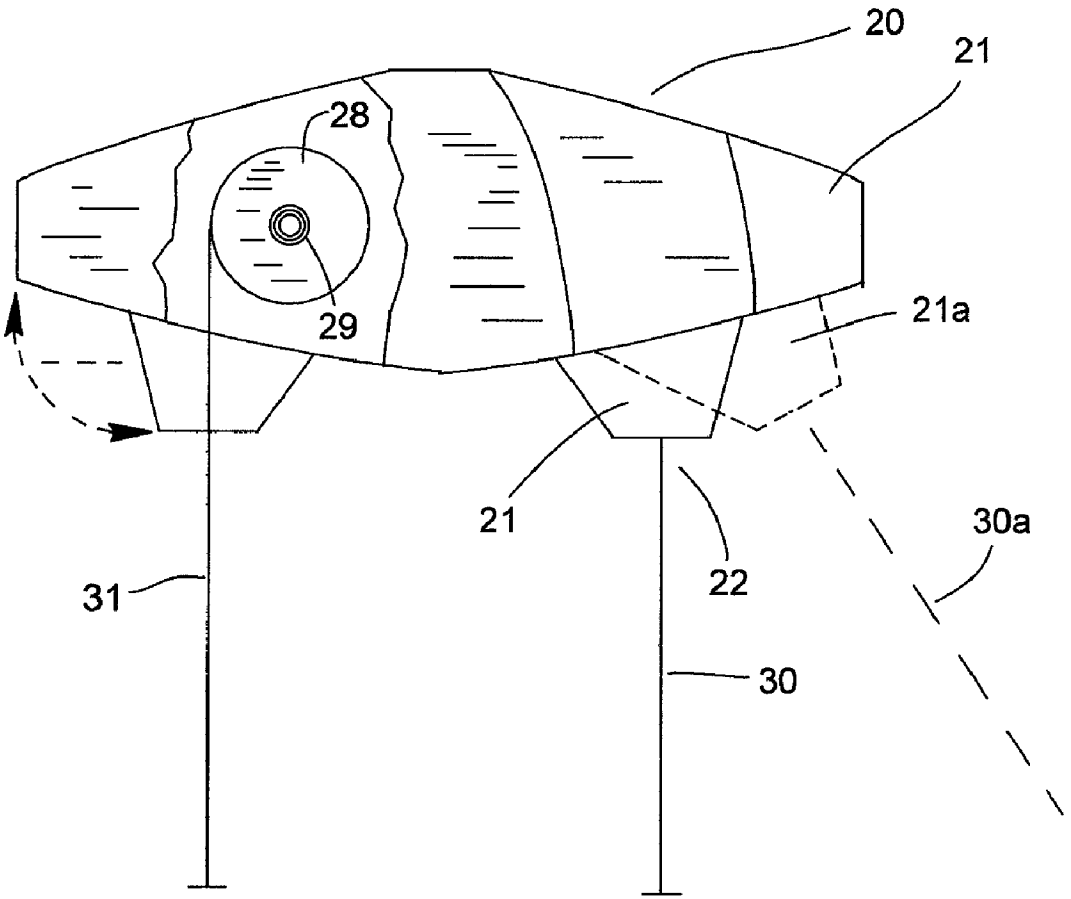
FIG. 10 shows a broken-away view of a device of the present invention with a tape spool.
Figure 11:
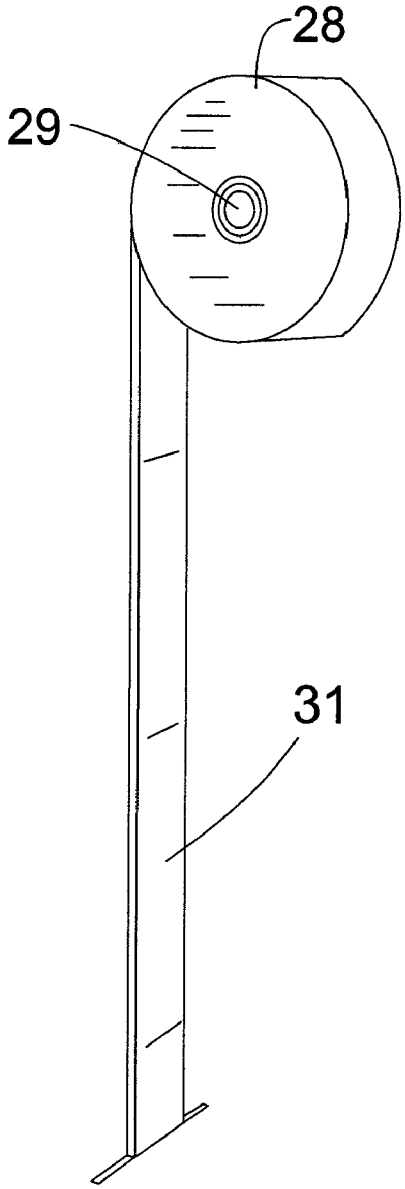
FIG. 11 shows the tape spool of FIG. 10.
Figure 12:
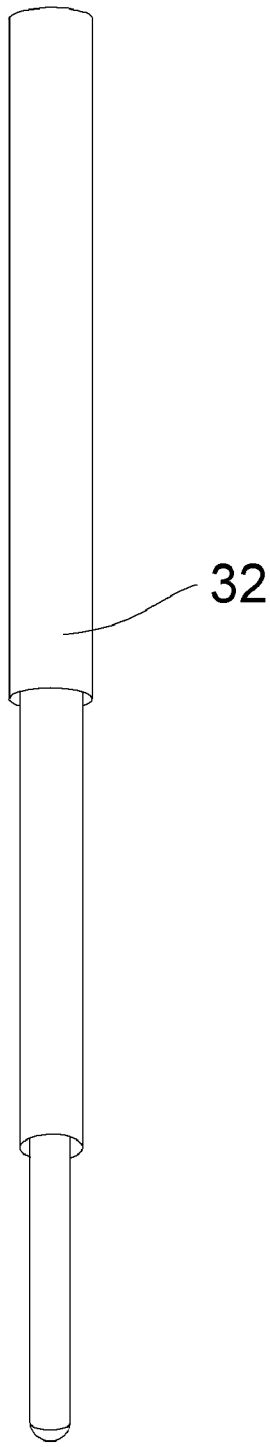
FIG. 12 shows the use of a telescoping tube or rod instead of tape.

FIG. 10 shows the embodiment of FIGS. 8-9 with a section of the cover cutout to reveal to mechanism that holds the tape 31. A spool 28 rotates on a spring hub 29 that contains an internal latching mechanism that will hold the tape in various positions. Alternatively, the tape can pass through a slit thin enough to provide resistance to the spring in the hub 29 so that the tape will stay extended to any length gently pushed back in. The tape mechanism can function identically to the mechanisms in tape measures known in the art. FIG. 11 shows a perspective view of the tape spool 28, the spring latching hub 29 and the tape 31 partially extended. FIG. 12 shows the use of telescoping tubing 32 or extendable rods instead of tape. The tubes or rods can telescope or otherwise be stored in the unit housing.

It should be noted that the present invention is not limited to golf or even sports. Rather, it can be used in numerous applications for alignment and making beams or lines in a plane such as for classroom blackboards, construction, etc., and it can be used in any sport that has directions of play.

Several descriptions and illustrations have been presented to aid in understanding the present invention. One with skill in the art will realize that numerous changes and variations can be made without departing from the spirit of the invention. Each of these changes and variations is within the scope of the present invention.

The invention claimed is:

1. A sport alignment device comprising:

a housing;

a plurality of extendable tubes or rods contained in said housing;

a pair of sliding/swivel heads attached to said housing, each containing at least one of said extendable tubes or rods, separation between said heads being adjustable, and wherein, first and second tubes or rods can be extended from each of said sliding/swivel heads at any angle with respect to said housing and at a plurality of distances from the first tube or rod to the second tube or rod.

2. The sport alignment device of claim 1 wherein said housing contains two extendable tube or rods.

3. The sport alignment device of claim 1 wherein when said housing contains at least three extendable tubes or rods.

4. The sport alignment device of claim 1 wherein at least two of said tubes or rods can be extended parallel to one-another at a plurality of distances from one-another.

5. The sport alignment device of claim 1 wherein said housing contains a third tube or rod extendable at any angle from said housing.

6. The sport alignment device of claim 1 wherein said tubes or rods telescope.

7. A sport alignment device comprising:

a housing;

three extendable tubes contained in said housing;

wherein, said each of said tubes is extendable in a different direction away from said device;

and wherein said housing contains two side ports each able to swivel through a plurality of angles and slide laterally inwardly and outwardly, at least two of said tubes exiting said housing through said side ports;

wherein two of said tubes can be extended parallel to one-another.

8. The sport alignment device of claim 7 wherein said tubes telescope.

9. The sport alignment device of claim 7 wherein said two tubes extendable parallel to one-another can be extended at an adjustable distance between them.

10. A sport alignment device comprising:

a housing;

three extendable tubes contained in said housing;

wherein, said each of said tubes is extendable in a different direction away from said device;

wherein two of said tubes can be extended parallel to one-another.

11. The sport alignment device of claim 10 wherein said tubes telescope.

12. The sport alignment device of claim 10 wherein distance between the two tubes that can be extended parallel to one-another is adjustable.

* * * * *